US011421184B2

(12) United States Patent
Flendrig et al.

(10) Patent No.: US 11,421,184 B2
(45) Date of Patent: Aug. 23, 2022

(54) CLEANING COMPOSITION WITH A SECOND DISPERSED PHASE AND MICROFIBRILLATED CELLULOSE

(71) Applicant: Conopco, Inc., Englewood Cliffs, NJ (US)

(72) Inventors: Leonardus Marcus Flendrig, Amsterdam (NL); Gerrit Jan Willem Goudappel, Hellevoetsluis (NL); Anke Kuijk, Eerbeek (NL); Sandra Joyce Veen, Amersfoort (NL); Orlin Dimitrov Velev, Cary, NC (US); Krassimir Petkov Velikov, Utrecht (NL); Jan Adrianus Verheij, Schiedam (NL); Yan Zeng, Sugar Land, TX (US)

(73) Assignee: CONOPCO, INC., Englewood Cliffs, NJ (US)

( * ) Notice: Subject to any disclaimer, the term of this patent is extended or adjusted under 35 U.S.C. 154(b) by 197 days.

(21) Appl. No.: 16/499,885

(22) PCT Filed: Mar. 19, 2018

(86) PCT No.: PCT/EP2018/056869
§ 371 (c)(1),
(2) Date: Oct. 1, 2019

(87) PCT Pub. No.: WO2018/184824
PCT Pub. Date: Oct. 11, 2018

(65) Prior Publication Data

US 2020/0115658 A1 Apr. 16, 2020

(30) Foreign Application Priority Data

Apr. 7, 2017 (EP) ..... 17165453

(51) Int. Cl.

| | |
|---|---|
| ***C11D 3/18*** | (2006.01) |
| ***C11D 3/22*** | (2006.01) |
| ***C11D 1/14*** | (2006.01) |
| ***C11D 3/00*** | (2006.01) |
| ***C11D 3/382*** | (2006.01) |
| ***C11D 3/43*** | (2006.01) |
| ***C11D 17/00*** | (2006.01) |

(52) U.S. Cl.
CPC ..... *C11D 3/222* (2013.01); *C11D 1/146* (2013.01); *C11D 3/0094* (2013.01); *C11D 3/382* (2013.01); *C11D 3/43* (2013.01); *C11D 17/0017* (2013.01)

(58) Field of Classification Search
CPC ..... C11D 17/0017; C11D 17/0021; C11D 17/0004; C11D 9/36; C11D 3/382; C11D 3/222; C11D 3/14
See application file for complete search history.

(56) References Cited

U.S. PATENT DOCUMENTS

| | | | | |
|---|---|---|---|---|
| 4,374,702 | A * | 2/1983 | Turbak | D01D 5/11 162/100 |
| 5,998,349 | A | 7/1999 | Guillou | |
| 6,241,812 | B1 | 6/2001 | Smith | |
| 7,776,807 | B2 * | 8/2010 | Canto | A61K 8/027 510/151 |
| 2003/0024556 | A1 | 2/2003 | Guiramand et al. | |
| 2008/0108714 | A1 | 5/2008 | Swazey | |
| 2014/0031305 | A1 | 1/2014 | Terrisse et al. | |
| 2014/0037816 | A1 * | 2/2014 | Bakeev | C08L 1/284 426/564 |
| 2014/0378362 | A1 | 12/2014 | Cooke et al. | |
| 2015/0203799 | A1 * | 7/2015 | Bettiol | C11D 3/2086 510/235 |
| 2017/0015949 | A1 * | 1/2017 | Johnson | C11D 3/38636 |
| 2018/0023042 | A1 * | 1/2018 | Lant | C08B 15/06 510/296 |
| 2019/0249115 | A1 * | 8/2019 | Labib | C11D 17/04 |

FOREIGN PATENT DOCUMENTS

| | | |
|---|---|---|
| CN | 1174567 | 2/1998 |
| CN | 1190431 | 8/1998 |
| CN | 103180423 | 6/2013 |
| CN | 104271724 | 1/2015 |
| CN | 104684936 | 6/2015 |
| CN | 105378046 | 3/2016 |
| EP | 2196186 | 6/2010 |

(Continued)

OTHER PUBLICATIONS

Winterburn et al.; Integrated recirculating foam fractionation for the continuous recovery of biosurfactant from fermenters; Biochemical Engineering Journal; 2011; pp. 132-139; vol. 54; Elsevier B.V.
Chabrand et al.; Destabilization of the Emulsion Formed during Aqueous Extraction of Soybean Oil; J. Am. Oil Chem. Soc.; 2008; pp. 383-390; vol. 85 No 4; Springer AOCS.
Written Opinion in PCTEP2018056869; dated Mar. 13, 2019.
Partial Search Report and Written Opinion in EP17165453; dated Oct. 30, 2017.
Partial Search Report and Written Opinion 2 in EP17165453; dated Feb. 6, 2018.
Search Report and Written Opinion in PCTEP2018056869; dated Apr. 20, 2018.
IPRP in PCTEP2018056869; Sep. 3, 2019.

(Continued)

*Primary Examiner* — Charles I Boyer
(74) *Attorney, Agent, or Firm* — Krista A. Kostiew

(57) ABSTRACT

The present invention is in the field of cleaning compositions. In particular it relates to liquid, gelled or pasty cleaning compositions comprising one or more detergent surfactants. The invention provides cleaning compositions comprising water, one or more detergent surfactants, a water immiscible oil-based phase, and defibrillated primary cell wall material comprising microfibrils. The invention also relates to a method for preparing a cleaning composition comprising water, one or more detergent surfactants and defibrillated primary cell wall material comprising microfibrils, wherein the method includes a high shear treatment step.

12 Claims, 2 Drawing Sheets

(56) References Cited

FOREIGN PATENT DOCUMENTS

| | | |
|---|---|---|
| EP | 2603196 | 6/2013 |
| EP | 2824169 | 1/2015 |
| GB | 2245281 | 1/1992 |
| WO | WO2012052306 | 4/2012 |
| WO | WO2013160024 | 10/2013 |
| WO | WO2014017913 | 1/2014 |
| WO | WO2014082951 | 6/2014 |
| WO | WO2014142651 | 9/2014 |
| WO | WO2016107793 | 7/2016 |
| WO | WO2017009042 | 1/2017 |

OTHER PUBLICATIONS

Nikolai D. Denkov; Mechanisms of 25 Foam Destruction by Oil-Based Antifoams; Langmuir; 2004; PP9463-9505; vol. 20 No. 22; American Chemical Society.
IPRP2 in PCTEP2018056869; dated Sep. 3, 2019; European Patent Office (EPO).

* cited by examiner

Water drainage with time at 2 wt. % SDS, 10 wt. % oil fraction and varying MFC concentration The characteristic decay time of foam volume (or water drainage) as a function of MFC concentration, $\tau = 25.7\ 10 - 11.9\ e^{-MFC/1.21}$

CLEANING COMPOSITION WITH A SECOND DISPERSED PHASE AND MICROFIBRILLATED CELLULOSE

CROSS REFERENCE TO RELATED APPLICATIONS

The present application is a U.S. National Phase Application under 35 U.S.C. § 371 of International Application No. PCT/EP2018/056869, filed on Mar. 19, 2018, which claims priority to European Patent Application No. 17165453.6, filed on Apr. 7, 2017, the contents of which are incorporated herein in their entireties.

FIELD OF THE INVENTION

The present invention relates to a cleaning composition. In particular, the invention relates to a cleaning composition comprising detergent surfactant, defibrillated primary cell wall material comprising microfibrils and a second (typically liquid) dispersed phase which is a water-immiscible oil-based phase (i.e., phase may be liquid or semi-solid). The invention also provides a method for preparing a cleaning composition and a composition obtainable by that method.

BACKGROUND OF THE INVENTION

Cleaning compositions comprising detergent surfactants are well-known in many fields of application, for instance for hard surface cleaning, dishwashing, laundry washing, skin care, scalp and hair care, oral care. Most surfactant compositions have a tendency to foam, in particular once they are diluted upon application. In many such applications, especially where consumers prepare suds or lathers from the cleaning composition themselves, such foaming is perceived as a sign of detergency. Often it is even perceived as a prerequisite for detergency. Therefore, good foam formation is a very desirable characteristic for many cleaning compositions.

Foam formation and stabilisation is particularly difficult in the presence of a second water immiscible oil-based component such as liquid mineral, silicon, etheric or triglyceride oils. Oils are known to act as antifoaming agents—they destroy the foam and make it extremely difficult to create foam from emulsions [see N. D. Denkov, Mechanisms of Foam Destruction by Oil-Based Antifoams, Langmuir, 2004, 20 (22), pp 9463-9505.] It is especially desirable that the foamy or frothy layer, once formed, does not disappear readily but remains in place for the consumer to observe. It is especially desirable in cases when a water insoluble second disperse phase is present (e.g. as conditioning or moisturising agent). However, optimising a formulation to provide such optimal foaming may negatively affect other characteristics. For example, a well-known way to enhance foaming is by using a larger quantity of surfactant present in a formulation. From a sustainability point of view, using more surfactant is very undesirable. Therefore, it would be desirable to provide an alternative way of enhancing the stability of the foam formed from cleaning compositions.

In WO2016/107793 applicants disclose use of microfibrillated cellulose from primary cell materials to show improved foam stability. However, the application does not teach or show that such foams will also be stable in the presence of a second disperse phase such as liquid oils. This is quite surprising.

WO 2014/142651 discloses use of particulate cellulose material (for instance from sugar beet pulp) for keeping gas bubbles suspended in a fluid water-based composition. The cellulose particles have a volume-weighted median major dimension within the range of 25-75 μm, as measured by laser light diffractometry and should not be defibrillated. Similarly, WO 2014/017913 discloses a liquid detergent product comprising the same type of non-defibrillated particulate cellulose material.

WO 2012/52306 relates to externally structured aqueous liquid detergent compositions, in which non-defibrillated citrus fibre is used to suspend particulates. WO 2013/160024 relates to similar compositions in which the tendency of activated citrus fibre to form visible residues on the wall of a container is overcome by the addition of polyacrylates. WO 2014/82951 discloses a dentifrice comprising calcium carbonate particles and non-defibrillated citrus fibre to improve the cleaning efficacy of those particles.

US 2008/0108714 discloses surfactant-thickened systems comprising microfibrous cellulose (bacterial cellulose) to improve the suspending properties of the system. It particularly discloses the combination of bacterial cellulose, xanthan gum and carboxymethyl cellulose is such systems.

U.S. Pat. No. 6,241,812 relates to sanitisers and disinfectants. It discloses the combination of reticulated bacterial cellulose with cationic surfactant and a co-agent (such as cationic hydroxyethyl cellulose, pregelatinized cationic starch, conventional cationic starch, cationic guar gum, gum tragacanth and chitosan) to prepare acid-stable cellulose fibre dispersions, with reduced precipitation and flocculation of the cellulose fibres.

WO2017/009042 relates to liquid cleaning compositions comprising one or more surfactants. The invention provides cleaning compositions comprising water, one or more detergent surfactants, electrolytes, abrasive particles and defibrillated primary cell wall material comprising microfibrils.

U.S. Pat. No. 5,998,349 discloses descaling formulations comprising between 0.05 and 1.5 wt. % of cellulose microfibrils having at least 80% of cells with primary walls, a pH of less than or equal to 2 and at least one detergent surfactant. The cellulose fibre is used to provide a pseudoplastic rheological profile, which is stable over time.

GB2245281 relates to a detergent composition comprising a sulfosuccinate surfactant and a hydroxysulphobetaine surfactant at a specific ratio.

Other references of which applicants are aware include US 2014/031305 to Terrisse; US 2003/024556 to Guiramand; US 2014/378362 to Cooke; EP 2603196 to Unilever; and EP 2196186 to KPSS. None of these references, or any other of references we are aware, disclose microfibers or microfibrils (e.g., microfiber cellulose, or "MFC") having a microstructure as required by our invention. This is defined by specific parameters describing how homogeneous is the network of fibers or microfibrils. Only when criteria defined by our invention are met (i.e., degree of disentanglement defined by CHP, FHP, FDP herein) are there seen significant enhancement of foam stabilization.

The present invention provides cleaning compositions that provide enhanced sensory properties to the consumer because of the presence of functional water immiscible liquid or semisolid oil based phase. It also is an object of the present invention to provide cleaning compositions with enhanced foam stability, without increasing the amount of detergent surfactants. Desirably, the enhanced foam stability is provided upon dilution of the cleaning composition when it is used. It is another object of the invention to provide such cleaning compositions that display enhanced foam stability, without negatively affecting other desirable properties of the composition, such as their detergent efficacy, their physical appearance and/or other sensory attributes. It is yet another object of the invention to provide cleaning compositions that have a reduced environmental impact, without affecting other desirable properties. It is a further object of the invention to provide a method for preparing such cleaning compositions.

SUMMARY OF THE INVENTION

We have found that one or more of these objects can be achieved using the cleaning composition of the present invention. In particular, it was surprisingly found that primary cell wall material comprising microfibrils, which has been defibrillated to a suitable level, such that the composition homogeneity parameter of the composition, the fibre defibrillation parameter of the primary cell wall material, or the fibre homogeneity parameter of the primary cell wall material has an appropriate value, can be used to provide cleaning compositions that upon dilution display good foamability and longer-lasting foams even when a second disperse phase is present.

Accordingly, in a first aspect the invention provides a cleaning composition, comprising a. Water;
b. 0.01 to 70 wt. % of one or more detergent surfactants in the aqueous phase;
c. 0.1 to 6 wt. % of defibrillated primary cell wall material comprising microfibrils in the aqueous phase; and
d. 1 to 70 wt. % of water immiscible oil-based phase wherein
   the primary cell wall material is sourced from plant parenchymal tissue,
   at least 80 wt. % of the microfibrils is smaller than 50 nm in diameter; and
   the cleaning composition has a composition homogeneity parameter ("CHP") in the aqueous phase of at least 0.030.

It should be noted that, while we define the second dispersed phase as being typically a liquid or semisolid oil based phase, there are times, and it is contemplated by this invention, when the dispersed phase can melt or freeze depending on temperature. For example, the dispersed phase may be low viscosity oil (e.g., volatile silicone oil, etheric oil); or semi-liquid like dispersed phase (e.g., petroleum jelly, gelled silicone oil, structured fat). All language and claims directed to "immiscible oil-based phase" encompass the dispersed phase whether in melted liquid or more semi-solid form. The oil based phase is present in an amount of from 1 to 70 wt %. It can be preferred that the amount is from 2 to 50 wt %, or from 3 to 40 wt % or that the maximum amount is 30 wt % or even 20 wt %. It could be preferred that the oil-based phase includes, preferably is, petrolatum; natural wax; partially or fully hydrogenated triglyceride oils; and mixtures thereof. Preferred triglyceride oils include soybean oil or sunflower oil.

Semi-solid oil based dispersed phase can also be oleogel (Edible Oleogels Structure and Health Implications, Edited by: Alejandro G. Marangoni and Nissim Garti) or particle structured oils.

Similarly, according to a second aspect, the invention provides a cleaning composition, comprising a. water;
b. 0.01 to 70 wt. % of one or more detergent surfactants;
c. 0.1 to 6 wt. % of defibrillated primary cell wall material comprising microfibrils; and
d. 1 to 70 wt. % of water immiscible second oil-based phase wherein
   the primary cell wall material is sourced from plant parenchymal tissue,
   at least 80 wt. % of the microfibrils is smaller than 50 nm in diameter; and
   the defibrillated primary cell wall material has a fibre homogeneity parameter ("FHP") of at least 0.022.

Likewise, according to a third aspect, the invention provides a cleaning composition, comprising a. water;
b. 0.01 to 70 wt. % of one or more detergent surfactants;
c. 0.1 to 6 wt. % of defibrillated primary cell wall material comprising microfibrils in the aqueous phase; and
d. 1 to 70 wt. % of water immiscible oil based phase wherein
   the primary cell wall material is sourced from plant parenchymal tissue;
   at least 80 wt. % of the microfibrils is smaller than 50 nm in diameter; and
   the defibrillated primary cell wall material has a fibre defibrillation parameter ("FDP") of at least 0.10 Hz.

Although only one of the parameters need be met, preferably two of these defined parameters are met, and, more preferably, all three are met.

The cleaning compositions of the present invention are typically in a liquid, gel or paste format. Liquids are a preferred format.

Cleaning compositions featuring desirable properties including enhanced foam stability can suitably be prepared by methods including a high shear treatment step. Therefore, in a fourth aspect, the present invention provides a method for preparing a cleaning composition, wherein the cleaning composition comprises a. water;
b. 0.01 to 70 wt. % of one or more detergent surfactants;
c. 0.1 to 6 wt. % of defibrillated primary cell wall material comprising microfibrils in the aqueous phase; and
d. 1 to 70 wt. % of water immiscible oil based phase and wherein
   the primary cell wall material is sourced from plant parenchymal tissue,
   at least 80 wt. % of the microfibrils is smaller than 50 nm in diameter;

and wherein the method comprises the steps of i. providing a source of primary cell wall material;
ii. dispersing the primary cell wall material in an aqueous phase, thereby to form an aqueous dispersion comprising between 0.1 and 6 wt. % of the primary cell wall material;
iii. dispersing the immiscible oil based phase in an aqueous phase,
iv. treating the aqueous dispersion to obtain a dispersion comprising defibrillated primary cell wall material, whereby the treatment includes a high shear treatment step selected from high pressure homogenisation at a pressure of between 500 and 2000 bar or microfluidising at a pressure of between 500 and 2000 bar;

wherein other constituents of the cleaning composition are independently mixed into the aqueous phase before step ii, between steps ii and iii, after step iii.

Likewise, in a fifth aspect, the invention provides a method for preparing a cleaning composition, wherein the cleaning composition comprises a. water;
b. 0.01 to 70 wt. % of one or more detergent surfactants; and
c. 0.1 to 6 wt. % of defibrillated primary cell wall material comprising microfibrils in the aqueous phase; and d. dispersing the immiscible oil based phase in an aqueous phase, and wherein the primary cell wall material is sourced from plant parenchymal tissue;

at least 80 wt. % of the microfibrils is smaller than 50 nm in diameter;

and wherein the method comprises the steps of i. providing a source of primary cell wall material;

ii. dispersing the primary cell wall material in an aqueous phase, thereby to form an aqueous dispersion comprising between 0.1 and 6 wt. % of the primary cell wall material; and iii. treating the aqueous dispersion to obtain a dispersion comprising defibrillated primary cell wall material, whereby the treatment includes one or more high shear treatment steps and wherein the treatment is such that the fibre defibrillation parameter FDP of the defibrillated primary cell wall material is at least 0.10 Hz or the fibre homogeneity parameter FHP of the defibrillated primary cell wall material is at least 0.022;

wherein other constituents of the cleaning composition are independently mixed into the aqueous phase before step ii, between steps ii and iii, or after step iii.

The methods according to the invention yield cleaning compositions displaying desirable properties, including the aforementioned enhanced foam stability. Therefore, according to a sixth aspect, the invention also provides a cleaning composition obtainable by the method according to the fourth and/or the fifth aspect of the invention.

According to a seventh aspect, the invention provides use of defibrillated cell wall material comprising microfibrils to increase the foam stability of a cleaning composition comprising water and 0.1 to 70 wt. % of one or more detergent surfactants, wherein the composition has a composition homogeneity parameter CHP in the aqueous phase of at least 0.030.

According to an eighth aspect, the invention provides use of defibrillated cell wall material comprising microfibrils to increase the foam stability of a cleaning composition comprising water and 0.1 to 70 wt. % of one or more detergent surfactants, wherein the composition has a fibre defibrillation parameter FDP of at least 0.010 Hz.

DETAILED DESCRIPTION OF THE INVENTION

Any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Unless specified otherwise, numerical ranges expressed in the format "from x to y" are understood to include x and y. When for a specific feature multiple preferred ranges are described in the format "from x to y", it is understood that all ranges combining the different endpoints are also contemplated. For the purpose of the invention ambient temperature is defined as a temperature of about 20 degrees Celsius.

Cleaning Composition

The cleaning composition according to any aspect of the invention is a composition intended to aid in cleaning, typically in a domestic environment. The cleaning composition preferably is in a liquid, gel or paste format, more preferably it is in a liquid format. Thus, it is preferred that the cleaning composition according to the present invention is a liquid cleaning composition. The precise format and formulation of the composition can suitably be adapted to the intended type of application, as is generally known by the skilled person. For example, a preferred format would be a hand dishwash composition, or a hard surface cleaning composition. However, other types of cleaning compositions are also contemplated. The cleaning composition comprises water, one or more detergent surfactants and defibrillated primary cell wall material. In addition, the cleaning composition may suitably comprise other ingredients that are typical for such cleaning compositions. For example, the composition may also comprise non-detergent surfactants, preservatives, etcetera.

Surfactant

There are few limitations on the type or the amount of the detergent surfactants. The detergent surfactant may be one type of surfactant, or a mixture of two or more surfactants. Synthetic surfactants preferably form a major part of the one or more detergent surfactants. Thus, the one or more detergent surfactants are preferably selected from one or more of anionic surfactants, cationic surfactants, non-ionic surfactants, amphoteric surfactants and zwitterionic surfactants. More preferably, the one or more detergent surfactants are anionic, nonionic, or a combination of anionic and nonionic surfactants. Mixtures of synthetic anionic and nonionic surfactants, or a wholly anionic mixed surfactant system or admixtures of anionic surfactants, nonionic surfactants and amphoteric or zwitterionic surfactants may all be used according to the choice of the formulator for the required cleaning duty and the required dose of the cleaning composition.

In general, the surfactants may be chosen from the surfactants described in well-known textbooks like "Surface Active Agents" Vol. 1, by Schwartz & Perry, Interscience 1949, Vol. 2 by Schwartz, Perry & Berch, Interscience 1958, and/or the current edition of "McCutcheon's Emulsifiers and Detergents" published by Manufacturing Confectioners Company or in "Tenside-Taschenbuch", H. Stache, $2^{nd}$ Edn., Carl Hauser Verlag, 1981; "Handbook of Industrial Surfactants" ($4^{th}$ Edn.) by Michael Ash and Irene Ash; Synapse Information Resources, 2008.

The anionic surfactant may include soap (salt of fatty acid). A preferred soap is made by neutralisation of hydrogenated coconut fatty acid, for example Prifac® 5908 (ex Croda). Mixtures of saturated and unsaturated fatty acids may also be used.

Nonionic detergent surfactants are well-known in the art. A preferred nonionic surfactant is a C12-C18 ethoxylated alcohol, comprising 3 to 9 ethylene oxide units per molecule. More preferred are C12-C15 primary, linear ethoxylated alcohols with on average 5 to 9 ethylene oxide groups, more preferably on average 7 ethylene oxide groups.

Examples of suitable synthetic anionic surfactants include sodium lauryl sulphate, sodium lauryl ether sulphate, ammonium lauryl sulphosuccinate, ammonium lauryl sulphate, ammonium lauryl ether sulphate, sodium cocoyl isethionate, sodium lauroyl isethionate, and sodium N-lauryl sarcosinate. Mostly preferred the synthetic anionic surfactants comprise the synthetic anionic surfactant linear alkylbenzene sulphonate (LAS). Another synthetic anionic surfactant suitable in the present invention is sodium alcohol ethoxy-ether sulphate (SAES), preferably comprising high levels of sodium C12 alcohol ethoxy-ether sulphate (SLES). It is preferred for the composition to comprise LAS.

In some embodiments, the one or more detergent surfactants preferably comprises synthetic anionic with nonionic detergent active materials and optionally amphoteric surfactant, including amine oxide.

In other embodiments, it is preferred that the one or more detergent surfactants comprise two different anionic surfactants, preferably linear alkyl benzene sulphonate and a sulphate, for example LAS and SLES.

Synthetic anionic surfactants can be present, for example, in amounts in the range from about 5% to about 70 wt. % of the one or more detergent surfactants.

The cleaning compositions may further comprise an amphoteric surfactant, wherein the amphoteric surfactant is present in a concentration of 1 to 20 wt. %, preferably 2 to 15 wt. % more preferably 3 to 12 wt. % of the one or more surfactants. Typical examples of suitable amphoteric and zwitterionic surfactants are alkyl betaines, alkylamido betaines, amine oxides, aminopropionates, aminoglycinates, amphoteric imidazolinium compounds, alkyldimethylbetaines or alkyldipolyethoxybetaines.

The cleaning composition according to any aspect of the invention comprises 0.01 to 70 wt. % of one or more detergent surfactants. The cleaning composition preferably comprises at least 0.2 wt. %, more preferably at least 0.5 wt. %, even more preferably at least 1 wt. %, even more preferably at least 5 wt. %, still more preferably at least 10 wt. %, and yet more preferably at least 15 wt. % of the one or more detergent surfactants. The cleaning composition preferably comprises up to 60 wt. %, more preferably up to 50 wt. %, even more preferably up to 40 wt. %, still more preferably up to 35 wt. %, still more preferably up to 30 wt. % and yet more preferably up to 25 wt. % of the one or more detergent surfactants. Thus, the cleaning composition preferably comprises from 0.2 to 60 wt. %, more preferably from 0.5 to 50 wt. %, even more preferably from 1 to 40 wt. %, still more preferably from 5 to 35 wt. %, still more preferably from 10 to 30 wt. % and yet more preferably from 15 to 25 wt. % of the one or more surfactants.

Primary Cell Wall Material

For the purpose of the invention "primary cell wall material" is defined as the cell wall material from which essentially all cold water soluble components have been removed, i.e. at a temperature of around 20 degrees Celsius. This can easily be achieved by washing with water.

The primary cell wall material is sourced (i.e. prepared) from plant parenchymal tissue. The microfibrils in the cleaning composition according to the invention are microfibrils obtained from primary cell wall material. The source of the plant parenchyma cells may be any plant that contains plant parenchyma cells having a cellulose skeleton. A plant cell wall typically contains cellulose and hemicellulose, pectin and in many cases lignin. This contrasts with the cell walls of fungi (which are made of chitin), and of bacteria, which are made of peptidoglycan. Primary plant cell walls contain lignin only in minor amounts, if at all. The primary cell wall material used in the cleaning composition according to the invention may comprise some lignin, like less than 10 wt. % calculated on total amount of cell wall material, but preferably does not contain substantial amounts of lignified tissue. Preferably, the primary cell wall material consists essentially of non-lignified tissue as understood by the skilled person in the area of plant biology.

Preferably, the source of primary cell wall material is selected from parenchymal tissue from fruits, roots, bulbs, tubers, seeds, leaves and combination thereof; more preferably is selected from citrus fruit, tomato fruit, peach fruit, pumpkin fruit, kiwi fruit, apple fruit, mango fruit, sugar beet, beet root, turnip, parsnip, maize, oat, wheat, peas and combinations thereof; and even more preferably is selected from citrus fruit, tomato fruit and combinations thereof. A most preferred source of primary cell wall material is parenchymal tissue from citrus fruit.

The primary cell wall material may optionally have undergone several pre-treatment steps before it is brought in the defibrillated state. Such pre-treatments include but are not limited to heating, cooking, washing, refining, depectinating, as long as the defibrillated cell wall material comprising microfibrils is present in the cleaning composition as required by the present invention. Hence, the parenchymal tissue may for instance also be provided in the form of a puree.

Microfibrils

In the context of the present invention, the microfibrils present in or derived from the primary cell wall material, are the strongly self-associated fibrous structures typically found in plant cell walls. In the native plant tissue, they are conventionally present in the form of aggregates from a few tens of nanometres to a few micrometres. These aggregates consist of the elementary microfibrils. These elementary microfibrils are well-known. A typical microfibril generally comprises about 36 aligned beta-1-4-glucose polymer chains.

The cleaning composition according to the invention comprises 0.1 to 4 wt. % of defibrillated primary cell wall material comprising microfibrils. Here, the wt. % of the total composition is based on the dry weight of the primary cell wall material from which essentially all cold water soluble components have been removed (i.e. the insoluble fraction, which is also understood as the fibre fraction). The amount of defibrillated cell wall material may suitably be selected to obtain the desired effect and depends on the overall product format. It may for instance also depend on the typical level of dilution upon application and the amount of defibrillated cell wall material required in the lather upon its formation to provide the enhanced foam stability to the lather. Preferably, the amount of defibrillated cell wall material in the cleaning composition according to the invention is from 0.2 to 3 wt. %, more preferably from 0.3 to 2 wt. %, more preferably from 0.5 to 1.5 wt. % and even more preferably from 0.7 to 1.2 wt. %.

Preferably, the microfibrils are obtained from the primary cell wall material by removing soluble and unbound sugars, protein, polysaccharides, oil soluble oils, waxes and phytochemicals (e.g. carotenoids, lycopene). This is suitably achieved using well-known techniques including cutting up the cell wall material, cooking, washing, centrifugation, decanting and drying as is well-known to the skilled person.

Preferably the primary cell wall material comprises at least 50 wt. % of microfibrils, more preferably at least 60 wt. %, even more preferably at least 70 wt. %, still more preferably at least 80 wt. %, even still more preferably at least 90 wt. % and most preferably the primary cell wall material consists essentially of microfibrils. Here, the wt. % is based on the dry weight of the primary cell wall material and the microfibrils.

Plant cell walls, especially in parenchymal tissue contain hemicelluloses and pectin in addition to cellulose. Thus, the microfibrils in the primary cell wall material may typically comprise cellulose, hemicellulose, and pectin. However, the primary cell wall material of the invention does not necessarily contain hemicellulose and/or pectin. The hemicellulose or part thereof may have been removed when the primary cell wall material is prepared from the plant parenchymal tissue. Therefore, the primary cell wall material of the invention optionally comprises hemicellulose, like for example in an amount of 0 to 40 wt. %. Preferably the primary cell wall material comprises hemicelluloses, preferably in an amount of up to 40 wt. %, like for example from 5 to 40 wt. %, and more preferably in an amount from 10 to 30 wt. %.

Likewise, the pectin or part thereof may have been removed when the primary cell wall material is prepared from the plant parenchymal tissue. Therefore, the primary cell wall material of the invention optionally comprises pectin, like for example in an amount of 0 to 30 wt. %. Preferably the primary cell wall material comprises pectin, preferably in an amount of up to 30 wt. %, like for example from 5 to 30 wt. %, and more preferably in an amount from 10 to 20 wt. %.

Preferably, the primary cell wall material of the invention comprises hemicelluloses and pectin.

The primary cell wall material in the cleaning composition of the invention comprises defibrillated cell wall material, i.e. the microfibrils that make up the fibers present in the primary cell wall are at least partially disentangled without breaking them. It is the degree of disentanglement that provides the cleaning composition of the present invention with its surprising properties. The, CHP, FHP and FDP parameters all correlate to this degree of disentanglement.

Preferably, the average length of the microfibrils from the defibrillated primary cell wall material is more than 1 micrometer and preferably more than 5 micrometers.

At least 80 wt. % of the microfibrils is smaller than 50 nm in diameter. Preferably at least 80 wt. % of the microfibrils is smaller than 40 nm in diameter, more preferably smaller than 30 nm, even more preferably smaller than 20 nm and still more preferably smaller than 10 nm. The microfibril diameter can be suitably determined using the method described in the Examples section below.

The primary cell wall material is suitably defibrillated by subjecting it to mechanical energy and/or cavitation thereby disentangling the cellulose-containing microfibrils. This can be done as part of the process for obtaining the microfibrils from the primary cell wall material, thus resulting in isolated defibrillated cell wall material comprising microfibrils. Alternatively, the primary cell wall material can be combined with one or more of the other ingredients of the cleaning composition (including for example the surfactant) wherein the resulting mixture is subjected to mechanical energy and/or cavitation thereby disentangling the microfibrils in the cellulose fibers. The required level defibrillation can also be arrived at by a succession of various such disentanglement treatments, for example by first subjecting a dispersion of the primary cell wall material to a high shear treatment, and at later stage subjecting a premix of the cleaning composition to another high shear treatment. Alternatively, if the pre-processing of the primary cell wall material provides sufficient disentanglement to yield the required level of defibrillation in the final cleaning composition, it may suffice if the manufacturing steps in which the primary cell wall material is combined with the other constituents of the cleaning composition include only mixing steps of relatively low shear.

The cellulose in the microfibrils in the defibrillated primary cell wall material in any of the compositions of the present invention preferably has an average degree of crystallinity of less than 50%. Preferably, the average degree of crystallinity of the cellulose in the microfibrils is less than 40%, more preferably less than 35% and even more preferably less than 30%. The table below shows the average degree of crystallinity of typical sources of cellulose microfibrils. It shows that the cellulose in primary cell wall material sourced from plant parenchymal tissue typically has a degree of crystallinity of less than 50 wt. %.

TABLE 1

Average degree of crystallinity of cellulose (all polymorph cellulose I)

| Source | Average degree of crystallinity (%) |
|---|---|
| Tomato fibers | 32 |
| Citrus fiber (Citrus Fiber AQ + N) | 29 |
| Nata de Coco | 74 |
| Cotton | 72 |
| Wood pulp fiber (Meadwestvaco) | 61 |
| Sugar beet fibre (Nordix Fibrex) | 21 |
| Pea fibres (PF200vitacel) | 42 |
| Oat fibres (780 Sunopta) | 43 |
| Corn hull (Z-trim) | 48 |
| Sugar cane Fiber (Ultracel) | 49 |

The average degree of crystallinity can be suitably determined according to the described in the Examples section below.

The composition homogeneity parameter CHP in the aqueous phase According to the first aspect of the invention, the cleaning composition has a composition homogeneity parameter CHP of at least 0.030. The CHP provides a measure for the extent to which the primary cell wall material has been defibrillated, based on confocal scanning laser microscopy (CSLM) performed on a standardised sample comprising the defibrillated cell wall material. The CHP of the cleaning composition is established by the following protocol. The protocol to establish the parameter includes three parts: sample preparation, CSLM microscopy to obtain micrographs of the sample, and digital image analysis to calculate the CHP value.

Thus, the protocol includes the sample preparation steps of a. preparing 300 ml of an aqueous, concentration-standardised sample at room temperature from the cleaning composition, wherein the concentration-standardised sample comprises the microfibrils contained in the defibrillated primary cell wall material at a concentration of 0.100 wt. % with respect to the weight of the standardised sample;
b. evenly distributing the primary cell wall material over the concentration-standardised sample volume by agitating the sample with a Silverson overhead mixer equipped with a small screen having 1 mm holes at 2000 rpm for 60 seconds;
c. dying the microfibrils by providing a 0.5%-w/v aqueous stock solution of Congo Red dye and contacting an aliquot of the standardised sample with an amount of the Congo Red solution, wherein the amount is 1.0 vol-% with respect to the volume of the aliquot of the standardised sample;
d. filling a sample holder suitable for performing CSLM with an aliquot of the dyed standardised sample.

In step c, for example, 2 mL of the standardised sample is contacted with 20 μl of the Congo Red solution. In order to ensure even distribution of the dye throughout the sample, it may for instance be gently shaken.

The sample holder of step d suitably includes two cover slides separated by a spacer comprising a bore of sufficient volume to enable the recording of sufficient micrographs for digital image analysis as described below.

To obtain micrographs, the protocol includes the following step:

e. imaging the dyed standardised sample with a confocal scanning laser microscope equipped with a diode-pumped solid state laser emitting at a wavelength of 561 nm and operated at a fixed laser power, using a 10× objective with a numerical aperture of 0.40, and thereby recording at least 25 independent micrographs at a resolution of 1024×1024 pixels where each pixel represents a sample size of within the range of 1490 by 1490 nm to 15400 by 1540 nm, adjusting the intensity and gain settings such that in every image between 0.1 and 5% of the pixels are saturated and recording the micrographs at a colour depth of at least 8 bits per pixel.

The CHP is a measure relating to the primary cell wall material. Therefore, micrographs should be recorded whilst avoiding imaging of air bubbles or the sample edge. Likewise, care should be taken to avoid imaging other objects of macroscopic dimensions that do not originate from the defibrillated primary cell wall material. This may conveniently be accomplished for instance by removing such objects of macroscopic dimensions during sample preparation in step a or by avoiding them in the sample whilst collecting micrographs.

Typically, one or more photomultiplier tubes are used as the light detectors in the microscope. Preferably, the microscope is equipped with three photomultiplier tubes (PMTs). Independent micrographs are micrographs that are non-overlapping, both in the x-y plane and in the z-direction. The micrographs may suitably be recorded at a colour depth higher than 8 bits (for instance at 24 bit RGB), since this can easily be converted to a lower colour depth by well-known means.

The digital image analysis part of the protocol involves the following steps:

f. ensuring that the micrographs are present as or converted to a format with a single intensity value for each pixel;

g. normalising each individual micrograph by recalculating the pixel values of the image so that the range of pixel values used in the image is equal to the maximum range for the given colour depth, thereby requiring 0.4% of the pixels to become saturated;

h. obtaining for each individual micrograph the image histogram and removing spikes from each histogram by visual inspection;

i. for each individual image histogram determining the full width at half maximum (FWHM), by first determining the maximum count in the histogram and the channel containing this maximum count (the maximum channel), then counting the number N of channels between the first channel containing a value equal or higher than half the maximum and the last channel containing a value equal or higher than half the maximum thereby including this first and last channel in the count N, and then calculating the FWHM by dividing the count N by the total number of channels;

j. calculating the composition homogeneity parameter CHP, wherein CHP is the average of the FWHM values obtained for the individual micrographs.

The digital image analysis steps may suitably be carried out using well-known image analysis software including for instance ImageJ. The result of step f should be that the image is of a format wherein the intensity for each pixel is expressed as a single value. This is for instance the case if the image is a "grey-scale" image. In contrast, images in RGB format or a related format having three intensity values per pixel should be converted. This is easily achieved by well-known operations in the field of digital image analysis. An example of a suitable output format would be a grey-scale image with 8 bits per pixel.

The normalising operation of step g is generally known as a histogram stretch operation or a contrast stretch operation. The normalisation is performed by allowing a small percentage of pixels in the image to become saturated. Here saturation includes both the minimum and maximum value for the given colour depth. In an 8 bit greyscale image, the minimum value would be 0 and typically displayed as black, whilst the maximum value would be 255 and typically displayed as white. The image histogram of step h is a well-known property for digital images, representing the distribution of the pixels over the possible intensities, by providing the pixel count for each intensity channel. For the purpose of the spike-removal of step h, the value for a particular channel is considered a spike if it is considerably higher than the values of the adjacent channels, typically at least a factor of 1.5 higher. The lower half-maximum channel in step i corresponds to the channel containing a count of half the maximum count that is furthest away from the maximum channel on the low-intensity side of the maximum channel. Analogously, the upper half-maximum channel corresponds to the channel containing a count of half the maximum count that is furthest away from the maximum channel on the high-intensity side of the maximum channel. The FWHM that is obtained in step i will be a value between 0 and 1.

A preferred way of establishing the CHP for the cleaning composition is by following the protocol in the way described in the Examples section below. The above protocol and the Examples provide methods of measuring the CHP. However, the CHP may also be determined by a different protocol, as long as that protocol would lead to the same physical result, i.e. it would yield the same CHP for a particular cleaning composition as the above protocol.

The cleaning composition preferably has a composition homogeneity parameter CHP of at least 0.031, more preferably at least 0.032, even more preferably at least 0.033, even more preferably at least 0.040 and still more preferably at least 0.050. Preferably, the cleaning composition has a CHP of at most 0.20, more preferably at most 0.15, and even more preferably at most 0.10.

The Fibre Homogeneity Parameter FHP

According to the second aspect of the invention, the degree of defibrillation of the primary cell wall material in the cleaning composition is suitably characterised by the fibre homogeneity parameter FHP. Like the CHP, the FHP is measured based on analysis of CSLM micrographs, but differs in the way the sample is prepared. The FHP is defined for the defibrillated primary cell wall material dispersed in water. That is, the FHP is determined for the separate primary cell wall material, not for the formulated cleaning composition.

Thus, the defibrillated primary cell wall material of the cleaning composition according to the fourth aspect of the invention has a fibre homogeneity parameter FHP of at least 0.022. The defibrillated primary cell wall material preferably has a fibre homogeneity parameter FHP of at least 0.025, more preferably at least 0.030, even more preferably at least 0.035, still more preferably at least 0.040, yet more preferably at least 0.045 and still more preferably at least 0.050. The defibrillated primary cell wall material preferably has a fibre defibrillation parameter FHP of at most 0.20, more preferably at most 0.15 and even more preferably at most 0.10.

The protocol to establish the FHP includes three parts: sample preparation, CSLM microscopy to obtain micrographs of the sample, and digital image analysis to calculate the FHP value, analogous to the protocol to establish the CHP.

Thus, the protocol includes the sample preparation steps of a. preparing 300 ml of a concentration-standardised sample at room temperature of the defibrillated primary cell wall material, wherein the concentration-standardised sample comprises the microfibrils contained in the defibrillated primary cell wall material at a concentration of 0.100 wt. % with respect to the weight of the standardised sample;
b. evenly distributing the primary cell wall material over the concentration-standardised sample volume by agitating the sample with a Silverson overhead mixer equipped with a small screen having 1 mm holes at 2000 rpm for 60 seconds;
c. dying the microfibrils by providing a 0.5%-w/v aqueous stock solution of Congo Red dye and contacting an aliquot of the standardised sample with an amount of the Congo Red solution, wherein the amount is 1.0 vol-% with respect to the volume of the aliquot of the standardised sample;
d. filling a sample holder suitable for performing CSLM with an aliquot of the dyed standardised sample.

The standardised sample of the defibrillated primary cell wall material may be prepared in different ways, which may be appropriately selected depending on the preparation conditions of the defibrillated primary cell wall material and/or the cleaning composition. Thus, for example, the standardised sample may suitably be prepared by using a dispersion consisting essentially of the defibrillated primary cell wall material dispersed in water, wherein the dispersion results from a defibrillation process. This is particularly useful, if the primary cell wall material is subjected to a defibrillation step before it is contacted with other constituents of the cleaning composition. A possible alternative is to separate the primary cell wall material from the other constituents of the cleaning composition, after the latter has been prepared.

To obtain micrographs, the protocol includes the following step:

e. imaging the dyed standardised sample with a confocal scanning laser microscope equipped with a diode-pumped solid state laser emitting at a wavelength of 561 nm and operated at a fixed laser power, using an oil-immersed 40× objective with a numerical aperture of 1.25, and thereby recording at least 25 independent micrographs at a resolution of 1024×1024 pixels where each pixel represents a sample size of within the range of 350 by 350 to 400 by 400 nm, adjusting the intensity and gain settings such that in every image between 0.1 and 5% of the pixels are saturated and recording the micrographs at a colour depth of at least 8 bits per pixel.

Notably, the objective lens (i.e. an oil-immersed 40× objective) used in the protocol to determine the FHP differs from that used in the protocol to determine the CHP (i.e. a 10× objective).

The further parts of the protocol to determine the FHP—namely the digital image analysis follows the same steps as steps f to j of the protocol described hereinabove for the determination of the CHP, with the proviso that in step j, the fibre homogeneity parameter FHP is calculated as the average of the FWHM values obtained for the individual micrographs.

A preferred way of establishing the FHP for the cleaning composition is by following the protocol in the way described in the Examples section below for the CHP, whilst taking into account the above differences between the methods to measure the CHP and the FHP. The above protocol and the Examples provide methods of measuring the FHP. However, the FHP may also be determined by a different protocol, as long as that protocol would lead to the same physical result, i.e. it would yield the same FHP for a particular cleaning composition as the above protocol.

The Fibre Defibrillation Parameter FDP

According to the third aspect of the invention, the degree of defibrillation of the primary cell wall material in the cleaning composition is suitably characterised by the fibre defibrillation parameter FDP. The FDP provides a measure for the extent to which the primary cell wall material has been defibrillated, based on an NMR (nuclear magnetic resonance) method performed on a standardised sample comprising the defibrillated cell wall material. Like the FHP, the FDP is defined for the defibrillated primary cell wall material dispersed in water. That is, the FDP is determined for the separate primary cell wall material, not for the fully formulated cleaning composition.

Thus, the defibrillated primary cell wall material of the cleaning composition according to the third aspect of the invention has a fibre defibrillation parameter FDP of at least 0.10 Hz. The defibrillated primary cell wall material preferably has a fibre defibrillation parameter FDP of at least 0.11 Hz, more preferably at least 0.12 Hz, even more preferably at least 0.13 Hz, even more preferably at least 0.15 Hz and still more preferably at least 0.18 Hz. The defibrillated primary cell wall material preferably has a fibre defibrillation parameter FDP of at most 0.50 Hz, more preferably at most 0.40 Hz, even more preferably at most 0.30 Hz and still more preferably at most 0.20 Hz.

The protocol to establish the fibre defibrillation parameter FDP includes three parts: sample preparation, NMR measurement to collect CPMG relaxation decay data, and data analysis to calculate the FDP value.

Thus, the protocol includes the sample preparation steps of a. preparing 300 ml of a concentration-standardised sample at room temperature of the defibrillated primary cell wall material, wherein the concentration-standardised sample comprises the microfibrils contained in the defibrillated primary cell wall material at a concentration of 0.100 wt. % with respect to the weight of the standardised sample;
b. evenly distributing the primary cell wall material over the concentration-standardised sample volume by agitating the sample with a Silverson overhead mixer equipped with a small screen having 1 mm holes at 2000 rpm for 60 seconds;
c. adjusting the pH of the concentration-standardised sample to 3.3±0.1;

d. transferring an aliquot of the concentration- and pH-standardised sample to a flat-bottom NMR tube of 10 mm diameter, ensuring a fill height such that upon placement of the sample in the NMR spectrometer of step h, the fill height is within the region where the radio frequent field of the coil of the NMR spectrometer is homogeneous.

The standardised sample of the defibrillated primary cell wall material may be prepared in different ways, which may be appropriately selected depending on the preparation conditions of the defibrillated primary cell wall material and/or the cleaning composition. Thus, for example, the standardised sample may suitably be prepared by using a dispersion consisting essentially of the defibrillated primary cell wall material dispersed in water, wherein the dispersion results from a defibrillation process. This way of preparing the standardised sample is preferred and is particularly useful if the primary cell wall material is subjected to a defibrillation step before it is contacted with other constituents of the cleaning composition. A possible alternative is to separate the primary cell wall material from the other constituents of the cleaning, after the latter has been prepared.

The distributing step b is intended to provide an even distribution of the microfibril material over the sample volume, whilst having a limited and controlled effect on the level of defibrillation of the sample. In step c, the pH is suitably standardised with the aid of citric acid. The optimal fill height in step d may depend on the type of NMR spectrometer used, as known by the skilled person. It will typically be about 1 cm.

In the further steps of the protocol, the concentration- and pH-standardised sample will be referred to as the standardised sample.

The data analysis requires comparison of a $T_2$ distribution curve (see below) of the standardised sample with a matrix reference sample, which should preferably be essentially free from microfibril material. Therefore, the protocol also includes the step of:

e. preparing a matrix reference sample by centrifuging an aliquot of the standardised sample in a 2 ml Eppendorf cup at a relative centrifugation force of 15000 for 10 minutes and transferring the supernatant to a flat-bottom NMR tube of 10 mm diameter, ensuring a fill height such that upon placement of the sample in the NMR spectrometer of step h, the fill height is within the region where the radio frequent field of the coil of the NMR spectrometer is homogeneous.

Subsequently, to collect and analyse the data, the protocol includes the steps of:

f. equilibrating the NMR tubes at a temperature of 20° C.;

g. recording relaxation decay data for the standardised sample at 20° C. on an NMR spectrometer operating at a proton resonance frequency of 20 MHz, using a CPMG (Carr Purcell Mayboom Gill) $T_2$ relaxation pulse sequence, with a 180° pulse spacing of 200 microseconds, and a recycle delay time of 30 seconds;

h. recording relaxation decay data for the matrix reference sample under the same conditions as in step h;

i. performing inverse Laplace transformation to the obtained decay data for both the standardised sample and the matrix reference sample, requiring $T_2$ to be in the range of 0.01 to 10 seconds;

j. identifying in the 12 distribution curve of the standardised sample the peak corresponding to the water protons of which the $T_2$ is averaged by exchange between the bulk water phase and the surface of the defibrillated primary cell wall material and identifying in the 12 distribution curve of the matrix reference sample the peak corresponding to the bulk water phase;

k. calculating $T_2$(sample), which is defined as the weighted average 12 value for the identified peak in the $T_2$ distribution curve of the standardised sample and similarly calculating $T_2$(matrix) which is defined as the weighted average 12 value for the identified peak in the 12 distribution curve of the matrix reference sample;

l. calculating the values of $R_2$(sample) and $R_2$(matrix), where:

$$R_2(\text{sample})=1/T_2(\text{sample}), \text{ and}$$

$$R_2(\text{matrix})=1/T_2(\text{matrix});$$

m. calculating the fibre defibrillation parameter FDP of the defibrillated primary cell wall material as $$\text{FDP}=R_2(\text{sample})-R_2(\text{matrix}).$$

The CPMG $T_2$ relaxation pulse sequence is well-known in the field of NMR spectroscopy (See *Effects of diffusion on free precession in nuclear magnetic resonance experiments,* Carr, H. Y., Purcell, E. M., *Physical Review*, Volume 94, Issue 3, 1954, Pages 630-638/*Modified spin-echo method for measuring nuclear relaxation times*, Meiboom, S., Gill, D., *Review of Scientific Instruments*, Volume 29, Issue 8, 1958, Pages 688-691) Suitable time domain NMR spectrometers are well-known to perform this type of spectroscopy are well-known. Similarly, the usual measures to ensure the recording of reliable data are well-known in the field of time domain NMR spectroscopy. For example, the field should be sufficiently homogeneous at the locus where the sample volumes are placed. The field homogeneity can be checked by verifying whether a reference sample of pure water, yields a $T_2$* (T-two-star) for water protons of more than 2 milliseconds.

The inverse Laplace transformation of step i may suitably be carried out using a non-negative least square constraints algorithm Isqnonneg (Lawson, C. L. and R. J. Hanson, *Solving Least Squares Problems*, Prentice-Hall, 1974, Chapter 23, p. 161), with the regularisation parameter lambda set to 0.2. Software packages suitable for implementing the algorithm and carrying out the transform are well-known, Matlab being an example of such software.

In step j the peak that is selected in the $T_2$ distribution curve of the standardised sample, typically is the dominant peak, if the system is sufficiently homogeneous. In general, the peak that should be selected in the $T_2$ distribution curve is that corresponding to water protons of which the $T_2$ is averaged by diffusion and chemical exchange between bulk and surface sites of the defibrillated primary cell wall material. This peak is particularly well-defined if the defibrillated primary cell wall material is evenly distributed over the standardised sample. In most typical cases, there will be only one such peak, as can be seen in the examples in the Examples section below.

The weighted average $T_2$ in step l is for example suitably calculated by the summation $$\frac{\sum I(T_2)\cdot T_2}{\sum I(T_2)}$$

Here, $I(T_2)$ is the intensity at value $T_2$ and both summations are over the width of the peak.

A preferred way of establishing the FDP for the cleaning composition is by following the protocol in the way described in the Examples section below for the FDP. The above protocol and the Examples provide methods of measuring the FDP. However, the FDP may also be determined by a different protocol, as long as that protocol would lead to the same physical result, i.e. it would yield the same FDP for a particular cleaning composition as the above protocol.

Combination of Parameters

Cleaning compositions wherein the above-specified requirements for the CHP, FHP, and FDP are simultaneously satisfied for more than one of the CHP, FHP, and FDP are also contemplated. For example, a cleaning composition wherein the composition homogeneity parameter CHP has a value as specified hereinabove and simultaneously a fibre defibrillation parameter FDP as defined hereinabove is preferred. Likewise, a cleaning composition wherein the fibre homogeneity parameter FHP has a value as specified hereinabove and simultaneously a fibre defibrillation parameter FDP as defined hereinabove is also preferred.

Immiscible Oil Based Phase (Dispersed Phase)

Compositions of the invention also comprise a second dispersed phase which is an oil-based phase immiscible in aqueous phase. This may comprise, for example, liquid mineral oil, silicone oil, etheric oil or triglycerides and their oleogels. More specifically, the dispersed oil-based phase may be a low viscosity oil (e.g., volatile silicone); or semi-liquid like dispersed phase (e.g., gelled silicone oil). Semi-liquid may also include oleogels or particle structured oils.

The oil based phase may comprise 1 to 70 wt. %, preferably 1 to 40 wt. %, more preferably 1 to 30% by wt. or 1 to 10% by wt. of the composition.

The invention is directed to the fact that unexpectedly good foam level is maintained even in the presence of such oil based phase. This is because of the presence of defibrillated primary cell wall material comprising microfibrils, wherein primary cell wall material, microfibrils, and other parameters (e.g., CHP, FHP, FDP) are as defined.

Methods

According to the fourth and fifth aspects, the invention relates to methods for preparing a cleaning composition as defined hereinabove. A cleaning composition made according to the present methods surprisingly provides enhanced foam stability, in particular if the composition is diluted to form suds or a lather. These surprising properties are believed to be due to the particular processing conditions and their effect on the primary cell wall material comprising microfibrils.

The methods according to the invention are methods wherein the cleaning composition comprises water, one or more detergent surfactants, and defibrillated primary cell wall material comprising microfibrils.

The method according to any aspect of the invention is preferably a method for preparing a cleaning composition according to the invention as described hereinabove. Thus, any preferences regarding the cleaning composition according to the invention apply here too. The method preferably is a method for preparing a cleaning composition in a form suitable for domestic use (including for example hand dish wash formulations). In particular it is preferred that it is a method for preparing a cleaning composition according to the first aspect of the invention, or according to the second aspect of the invention, or according to the third aspect of the invention.

The primary cell wall material is preferably sourced as indicated for the cleaning composition above. It is particularly preferred that the primary cell wall material includes citrus fibre.

Method According to the Fourth Aspect of the Invention

Step ii of the method according the fourth aspect of the invention involves dispersing the primary cell wall material in an aqueous phase. Any method to disperse the primary cell wall material is considered, as long as it yields a dispersion that is suitable for the treatment in step iii. Thus, the dispersion step may involve stirring, mixing, or another treatment of relatively low shear, such as treatment with an overhead or inline Silverson mixer.

The aqueous dispersion of step ii comprises between 0.1 and 1 wt. % of the primary cell wall material. Preferably, it comprises between 0.1 and 3 wt. %, more preferably between 0.5 and 1.5 wt. % of the primary cell wall material.

The treatment of step iii to obtain a dispersion comprising defibrillated primary cell wall material involves subjecting the primary cell wall material to mechanical shearing and/or cavitation. To this effect, the treatment includes a high shear treatment step selected from high pressure homogenisation at a pressure of between 500 and 2000 bar and microfluidising at a pressure of between 500 and 2000 bar.

Both high pressure homogenisation and microfluidisation are well-known techniques, involving well-known equipment. Preferably, the high shear treatment step is high pressure homogenisation as specified, more preferably, it is high pressure homogenisation at a pressure of between 500 and 1000 bar, and even more preferably at a pressure of between 600 and 800 bar.

Thus, it is especially preferred that the aqueous phase of step ii comprises between 0.2 and 1 wt. % of the primary cell wall material and the high shear treatment step of step iii is high pressure homogenisation at a pressure of between 600 and 800 bar.

The precise pressure and the number of passes and/or stages of the treatment—be it high pressure homogenisation or microfluidisation—that is required to obtain the benefits of the present invention may depend for instance on the concentration of the primary cell wall material present and on its level of comminution/pre-treatment before this step, but is easily determined by experimentation.

The treatment in step iii is such that upon this treatment the fibre homogeneity parameter FHP of the defibrillated primary cell wall material is at least 0.022. Here the fibre defibrillation parameter FHP is defined and determined as described above. The defibrillated primary cell wall material preferably has a fibre homogeneity parameter FHP of at least 0.025, more preferably at least 0.030, even more preferably at least 0.035, still more preferably at least 0.040, yet more preferably at least 0.045 and still more preferably at least 0.050. The defibrillated primary cell wall material preferably has a fibre defibrillation parameter FHP of at most 0.20, more preferably at most 0.15 and even more preferably at most 0.10.

Similarly, it is also preferred that the treatment in step iii is preferably such that upon this treatment the fibre defibrillation parameter FDP of the defibrillated primary cell wall material is at least 0.10 Hz. Here the fibre defibrillation parameter FDP is defined and determined as described above. The defibrillated primary cell wall material preferably has a fibre defibrillation parameter FDP of at least 0.11 Hz, more preferably at least 0.12 Hz, even more preferably at least 0.13 Hz, even more preferably at least 0.15 Hz and still more preferably at least 0.18 Hz. The defibrillated primary cell wall material preferably has a fibre defibrillation parameter FDP of at most 0.50 Hz, more preferably at most 0.40 Hz, even more preferably at most 0.30 Hz and still more preferably at most 0.20 Hz.

The FHP and/or FDP can in particular be conveniently determined if the aqueous dispersion consists substantially of water and primary cell wall material, since in that case, the sample preparation step of the protocols to determine the FDP and/or FHP are relatively straight-forward.

Surprisingly beneficial properties of the cleaning composition made by the present method (in terms of enhanced foam stability whilst maintaining other desirable properties) are obtained when the treatment in step iii is such that the above preferred requirements for the FDP and/or the FHP are met.

Constituents of the cleaning composition other than the primary cell wall material are independently mixed into the aqueous phase before step ii, between steps ii and iii, between steps iii and iv or after step iv. These constituents include the one or more detergent surfactants. The other constituents can be mixed at the stage that is most convenient and/or efficient depending on the type of constituents and the product format as will be known and appreciated by the skilled person. However, care should be taken that the aqueous dispersion in step iii is suitable for the treatment it is subjected to.

The method according to the invention may suitably involve other routine steps and equipment that are usual and well-known in the field of manufacture of cleaning compositions, in particular with regard to cleaning compositions for domestic use.

Method According to the Fifth Aspect of the Invention

The preferences and considerations relating to the method according to the fourth aspect of the invention similarly apply to this method. Thus, for instance, the treatment of step iii typically involves one or more high-shear treatments selected from high pressure homogenisation and microfluidising. For this method any number and order of such treatment steps is contemplated as long as the requirements of the FDP and/or FHP are met for the resulting cleaning composition. Other steps may be present in between such multiple shearing steps, including for example the mixing in of other ingredients.

The treatment of step iii is such that that the fibre defibrillation parameter FDP of the defibrillated primary cell wall material is at least 0.10 Hz or the fibre homogeneity parameter FHP of the defibrillated primary cell wall material is at least 0.022. Preferably, the treatment is such that the fibre defibrillation parameter FDP is at least 0.11 Hz, more preferably at least 0.12 Hz, even more preferably at least 0.13 Hz, even more preferably at least 0.15 Hz and still more preferably at least 0.18 Hz. The fibre defibrillation parameter FDP preferably is at most 0.50 Hz, more preferably at most 0.40 Hz, even more preferably at most 0.30 Hz and still more preferably at most 0.20 Hz.

The defibrillated primary cell wall material preferably has a fibre homogeneity parameter FHP of at least 0.025, more preferably at least 0.030, even more preferably at least 0.035, still more preferably at least 0.040, yet more preferably at least 0.045 and still more preferably at least 0.050. The defibrillated primary cell wall material preferably has a fibre defibrillation parameter FHP of at most 0.20, more preferably at most 0.15 and even more preferably at most 0.10.

Cleaning composition obtainable by the methods of the invention According to the sixth aspect, the present invention relates to a cleaning composition obtainable by a method according to the invention, because the method according to the invention yields cleaning compositions exhibiting desirable properties, including enhanced foam stability by virtue of the particular structure that results from this method.

It is preferred that the cleaning composition is obtainable by the method according to the fourth aspect of the invention wherein the aqueous dispersion of step ii comprises between 0.1 and 1.0 wt. % of the primary cell wall material and the high shear treatment step of step iii is high pressure homogenisation at a pressure of between 700 and 1000 bar.

Likewise, it is preferred that the cleaning composition is obtainable by the method according to the fourth or the fifth aspect of the invention, wherein the treatment in step iii is such that upon this treatment the fibre defibrillation parameter FDP of the defibrillated primary cell wall material is at least 0.10 Hz. Here the fibre defibrillation parameter FDP is defined and determined as described above. The defibrillated primary cell wall material preferably has a fibre defibrillation parameter FDP of at least 0.11 Hz, more preferably at least 0.12 Hz, even more preferably at least 0.13 Hz, even more preferably at least 0.15 Hz and still more preferably at least 0.18 Hz. The defibrillated primary cell wall material preferably has a fibre defibrillation parameter FDP of at most 0.50 Hz, more preferably at most 0.40 Hz, even more preferably at most 0.30 Hz and still more preferably at most 0.20 Hz.

Analogously, it is preferred that cleaning composition is obtainable by the method according to the fourth or the fifth aspect of the invention, wherein the treatment in step iii is such that upon this treatment the fibre homogeneity parameter FHP of the defibrillated primary cell wall material is at least 0.022. The defibrillated primary cell wall material preferably has a fibre homogeneity parameter FHP of at least 0.025, more preferably at least 0.030, even more preferably at least 0.035, still more preferably at least 0.040, yet more preferably at least 0.045 and still more preferably at least 0.050. The defibrillated primary cell wall material preferably has a fibre defibrillation parameter FHP of at most 0.20, more preferably at most 0.15 and even more preferably at most 0.10.

Uses According to the Present Invention

The invention also relates to use of defibrillated cell wall material comprising microfibrils to increase the foam stability of a cleaning composition comprising water and 0.01 to 70 wt %, preferably 0.1 to 70 wt. % of one or more detergent surfactants, wherein the cleaning composition has a composition homogeneity parameter CHP of at least 0.030. Here the CHP is defined and determined as described above. The cleaning composition preferably has a composition homogeneity parameter CHP of at least 0.031, more preferably at least 0.032, even more preferably at least 0.033, even more preferably at least 0.040 and still more preferably at least 0.050. Preferably, the cleaning composition has a CHP of at most 0.20, more preferably at most 0.15, and even more preferably at most 0.10

The invention also relates to use of defibrillated cell wall material comprising microfibrils to increase the foam stability of a cleaning composition comprising water and 0.01 to 70 wt %, preferably 0.1 to 70 wt. % of one or more detergent surfactants, wherein the defibrillated cell wall material has a fibre defibrillation parameter FDP of at least 0.010 Hz. Here the fibre defibrillation parameter FDP is defined and determined as described above. The defibrillated primary cell wall material preferably has a fibre defibrillation parameter FDP of at least 0.11 Hz, more preferably at least 0.12 Hz, even more preferably at least 0.13 Hz, even more preferably at least 0.15 Hz and still more preferably at least 0.18 Hz. The defibrillated primary cell wall material preferably has a fibre defibrillation parameter FDP of at most 0.50 Hz, more preferably at most 0.40 Hz, even more preferably at most 0.30 Hz and still more preferably at most 0.20 Hz.

The invention also relates to use of defibrillated cell wall material comprising microfibrils to increase the foam stability of a cleaning composition comprising water and 0.1 to 70 wt. % of one or more detergent surfactants, wherein the cleaning composition has a composition homogeneity parameter FHP of at least 0.022. The defibrillated primary cell wall material preferably has a fibre homogeneity parameter FHP of at least 0.025, more preferably at least 0.030, even more preferably at least 0.035, still more preferably at least 0.040, yet more preferably at least 0.045 and still more preferably at least 0.050. The defibrillated primary cell wall material preferably has a fibre defibrillation parameter FHP of at most 0.20, more preferably at most 0.15 and even more preferably at most 0.10.

FIGURES

EXAMPLES

Figure 1:
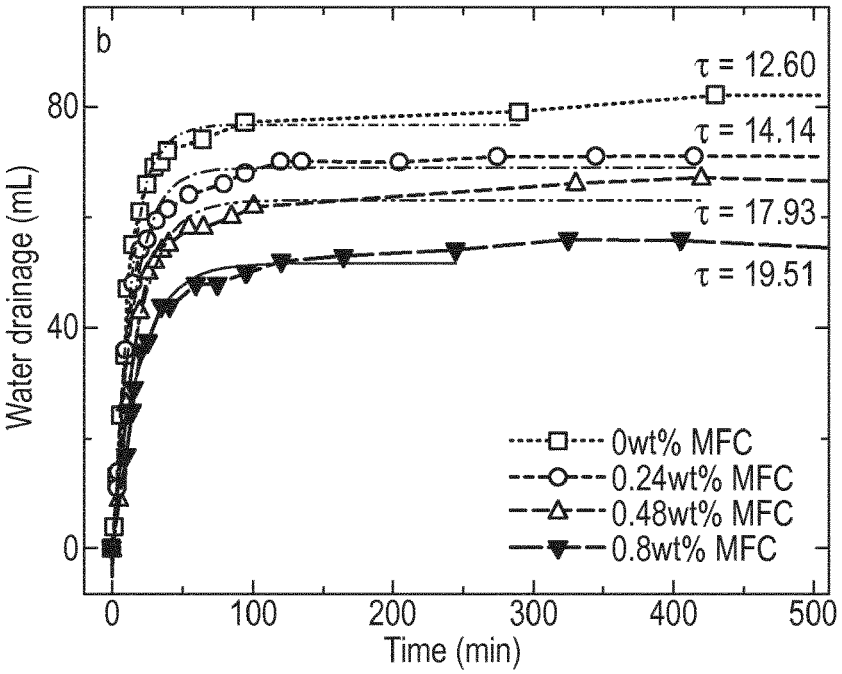
FIG. 1 is a figure demonstrating the effect of MFC concentration on drainage of water from a foam.

The invention can be better understood by virtue of the following non-limiting examples.

General

Microfibril Characterisation: Degree of Crystallinity of Cellulose-Containing Microfibrils Wide angle X-ray scattering (WAXS) is used to determine the degree of crystallinity, using the following protocol. The measurements were performed on a Bruker D8 Discover X-ray diffractometer with GADDS (General Area Detector Diffraction System) (From Bruker-AXS, Delft, NL) (Part No: 882-014900 Serial No: 02-826) in a theta/theta configuration. A copper anode was used, and the K-alpha radiation with wavelength 0.15418 nm was selected. The instrumental parameters as used are shown in the table below.

TABLE 2

D8 Discover instrumental parameters for WAXS measurements

| | 2θ (9-42°) |
|---|---|
| Theta 1 | 10.000 |
| Theta 2 | 10.000/25.000 |
| Detector Bias (kV/mA) | 40/40 |
| Time (sec) | 300 |
| Collimator (mm) | 0.3 |
| Detector distance (cm) | 25 |
| Tube Anode | Cu |

The degree of crystallinity Xc was calculated from the following equation:

$$X_C(\%) = \frac{\text{Area crystalline phase}}{\text{Area crystalline+ amorphous phase}} * 100\%$$

The areas of the diffraction lines of the crystalline phase were separated from the area of the amorphous phase by using the Bruker EVA software (version 12.0).

Microfibril Characterisation: Diameter of Microfibrils

Transmission electron microscopy (TEM) was used to directly determine the diameter of the microfibrils (D. Harris et. al. Tools for Cellulose Analysis in Plant Cell Walls Plant Physiology, 2010(153), 420). The dispersion of plant source rich in primary cell wall material was diluted in distilled water resulting in a thin layer of mostly single fibers or single clusters of fibers. The dispersions were imaged on a Carbon only 300 mesh Copper TEM grid (Agar Scientific) and imaged using a Tecnai 20 Transmission electron microscope (FEI Company) operated at a voltage of 200 kV. To enhance image contrast between individual microfibrils, a 2% phosphotungstic acid solution at pH 5.2 was used as a negative stain. For this the fiber-loaded TEM grids were incubated on 2% phosphotungstic acid and air-dried after removal of the excess of fluid.

Centrifugation Force

Where the centrifugation force is given, it is given as a dimensional "relative centrifugal force", which is defined as $r\,\omega^t/g$, where $g=9.8\ m/s^2$ is the Earth's gravitational acceleration, r is the rotational radius of the centrifuge, ω is the angular velocity in radians per unit time. The angular velocity is $\omega=rpm\times 2\pi/60$, where rpm is the centrifuge "revolutions per minute".

Examples 1 Foam Stabilization in the Presence of Second Oil-Based Dispersed Phase Materials.

Microfibrillated cellulose (MFC) suspension from citrus fibre (CF), containing about 50% cellulose was prepared as follows. 2% CF was allowed to swell while stirring using a Silverson high speed mixer at 5000 RPM for 10 minutes. To the 2 wt. % suspension the preservative potassium sorbate was added. Then the dispersion was processed through a microfluidizer at 1200 bar (1 pass). Finally, the pH of the MFC was adjusted to 2 by using 1M HCl (for extra preservation).

The MFC was diluted with Milli-pore water to the appropriate concentration prior to use. All MFC stock suspensions with varying concentration (0.3 wt. %, 0.6 wt. %, 1 wt. %), obtained from dilution of the 2 wt. % MFC, were adjusted to the same pH (≈7) and ionic strength (k 0.02 M). The pH of the suspensions was adjusted using sodium hydroxide (NaOH, Fisher); the ionic strength of the suspensions was adjusted using potassium sorbate (Acros Organics). The diluted MFC dispersion was passed through the Colloid Mill module of the IKA Magic Lab at a speed of approximate 10,000 rpm for 10 minutes. This resulted in the production of a colloidal stable dispersion of diluted MFC. The sodium dodecyl sulphate (SDS) was purchased from Sigma Aldrich and the solution was prepared by dissolving 2 gram in Milli-pore water with total volume of 20 ml. The soybean oil was purchased from MP Biomedicals and used directly.

Foam Generation.

During pure foam generation, 80 ml of MFC dispersion of the appropriate concentration was measured and poured into an industrial blender (Oster Model 4242), and 20 ml of SDS solution was added to the blender afterwards. For the case of aerated emulsions appropriate amount of soybean oil, X ml, was added, while 0.8*(100−X) ml of MFC dispersion and 0.2*(100−X) ml of SDS solution were then added in order to keep the total volume of the pre-blended mixture constant at 100 ml. The volume ratio between MFC dispersion and SDS solution is kept at 8:2, so that the MFC concentration in aqueous phase is always 80% of the initial concentration and SDS concentration is always 2 wt. % in aqueous phase. Foam was generated through aeration of the pre-blended mixture at 15,000 rpm for 1 minute, with keeping the lid of the blender slightly open.

Foam Characterization. Subsequent to the aeration step, foam was poured into sealed graduated (measuring) plastic cylinders and the volume of the foam was monitored over time. Initial foam volume was immediately noted after transfer from the blender into the graduated cylinder. The volume of the foam was monitored over time using the volume markers on the graduated cylinder.

Example 1: Effect of MFC Concentration on the Foamability of Oil-in-Water Emulsions Foams prepared at higher MFC concentration appear to be creamier and are more difficult to pour from the blender into the testing cylinder. Foams initially contain one phase of well mixed air-water-oil-solid and are general white in colour. The air bubbles in the foam are spherical in shape.

FIG. 1 shows water drains fast within first 400 minutes and slows down afterwards. In the case of absence MFC, the amount of water drainage up to 500 minutes is 82 ml, which is near to the total aqueous volume before blending, i.e. 90 ml. By increasing MFC concentration, the amount of water drainage reduces, While not wishing to be bound by theory, this is believed to be due to the increased local viscosity through the formation of a structured MFC network in the interstitial liquid film between the foam bubbles.

Figure 2:
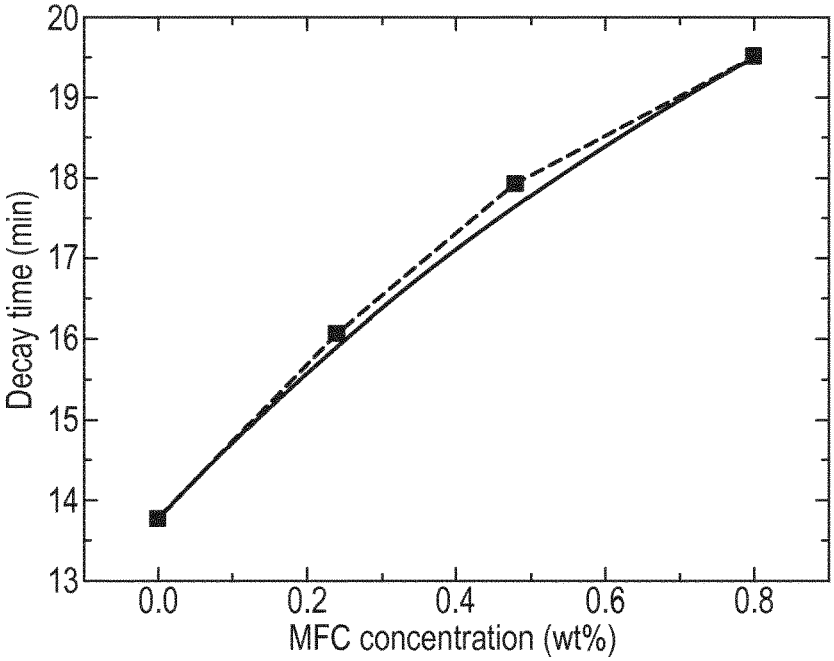
FIG. 2 shows that, even in the presence of oils, foam stability is maintained as quantified by the characteristic decay time.

The characteristic decay time, $\tau$, increases with MFC concentration with function $\tau=25.7-11.9\ e^{-MFC/1.21}$ (see FIG. 2).

FIG. 2 indicates surprisingly that in the presence of oil, MFC can still improve the foam stability.

Examples 2 Effect of Oil Fraction on the Foam Stability

Foams were prepared at 2 wt. % SDS, 0.48 wt. % MFC (in aqueous phase) and varying soybean oil fraction: 0.5 wt. %, 10 wt. %, 20 wt. %, 30 wt. %, 40 wt. %, 50 wt. %, 60 wt. %, and 70 wt. % oil. It has been quite surprisingly found that foams become denser and creamier with increasing oil fraction since increased oil is normally associated with decreased foam. Up to 60 wt. %, the foam is still fluid-like and, at 70 wt. %, the foam becomes a creamy paste. In general, water drains out with time and the bubbles in the foam become larger. Foams last at least for 6-7 hours and no collapse takes place. As indicated, it is surprising that the combination of MFC, surfactant and oil is more stable than if no oil is used. It is believed the cellulose microfibrils are compressed into plateau border after bubble formation, while oil droplets are closely packed into plateaus border also; both lead to a thicker bubble "wall" which is believed to stop bubble coalescence. Further, the MFC is believed to slow water drainage because of increased local viscoelasticity and decreased permeability.

Figure 3:
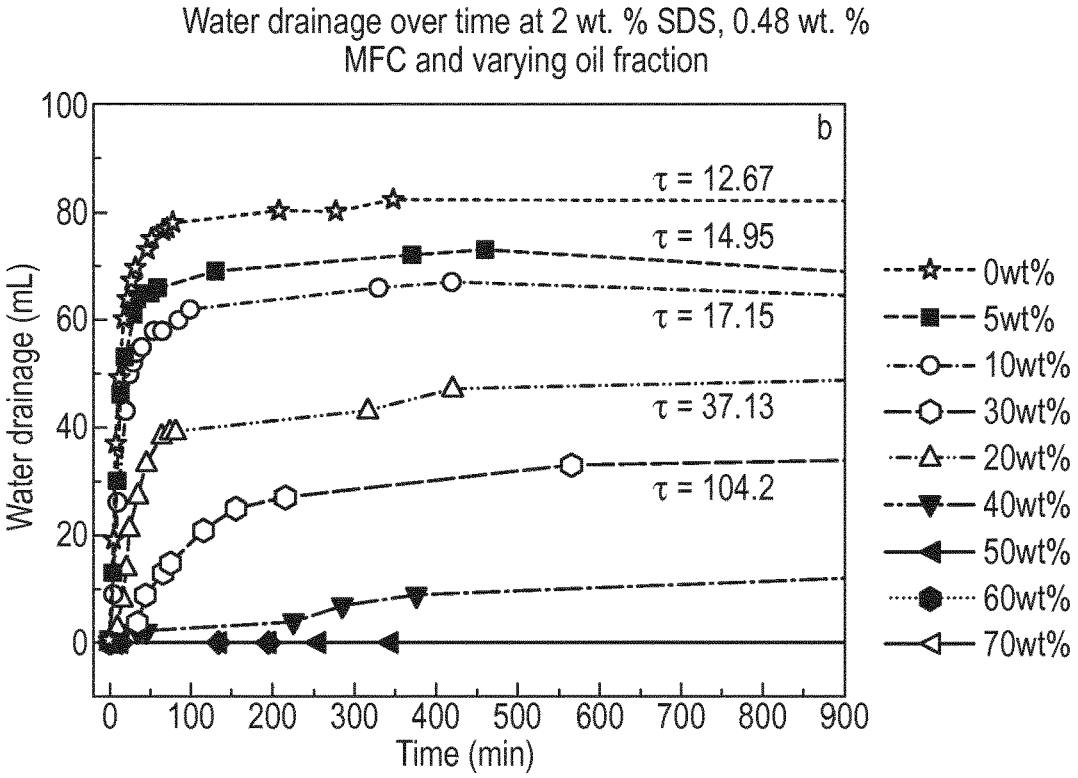
FIG. 3 shows water drainage based on varying amounts of oil.

FIG. 3 shows water drains fast within first 200-400 minutes and slows down afterwards. In the case of absence of oil, the amount of water drainage up to 1500 minutes is 80 ml, which is lower than the total aqueous volume before blending, 100 ml, while at the same time foam volume is around zero (FIG. 3). This is believed to occur because oil creams and packs water closely in between. By increasing oil fraction, the amount of water drainage reduces and, after 900 minutes, there is still water remaining in the network. Taking the initial aqueous phase volume into account, the percentage of water drainage up to 900 minutes in FIG. 3 is approximately 80%, 70%, 65%, 50%, 30%, 10% and 0% for foam containing 0 wt. %, 5 wt. %, 10 wt. %, 20 wt. %, 30 wt. %, 40 wt. %, and 50 wt. % oil, respectively. (These numbers are visually estimated, but can be calculated more precisely). As noted, this reduction in percentage of water drainage is most likely due to an increased local viscosity and decreased permeability.

Figure 4:
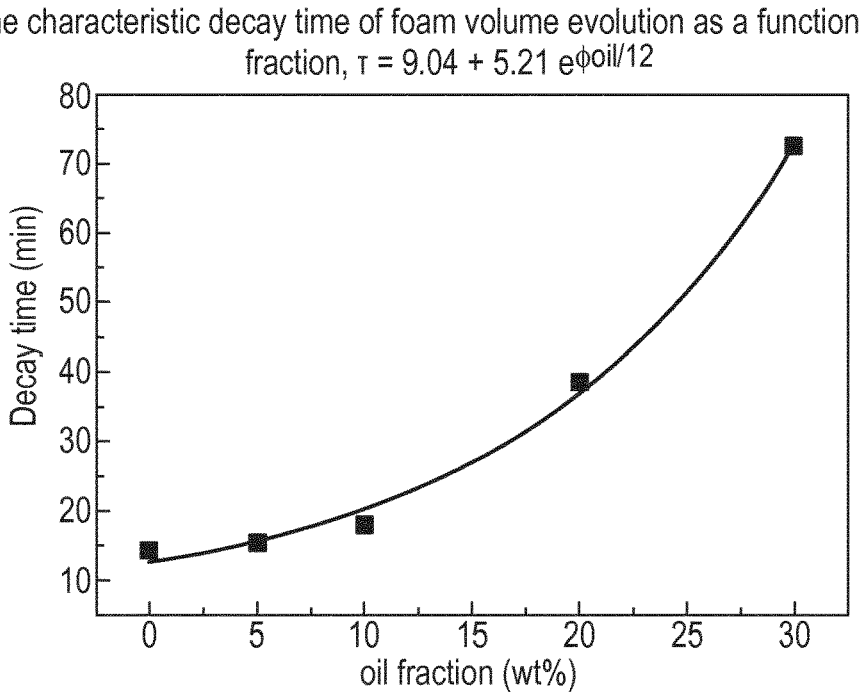
FIG. 4 shows that foam stability increases as function of oil as quantified by the characteristic decay time of foam.

The fitted characteristic decay time of the change in water drainage is close to that obtained from the fitting of foam volume (see FIG. 4). The characteristic decay time, $\tau$, increases with oil fraction with function $r=9.04+5.21e^{\Phi oil/12}$ (FIG. 4). This indicates the presence of oil phase improves the foam stability by retarding the water drainage and therefore the foam volume. Again, this is quite surprising. Without being bound by theory the reason is related to the packing of oil droplets between bubbles and consequently the increased local viscosity of the medium and decreased permeability of water.

This shows that the presence of a second dispersed oil based phase that is immiscible with water further increase the stability of the foam.

The invention claimed is:

1. A cleaning composition, comprising:

a. water;

b. 2 to 70 wt. % of one or more detergent surfactants; and c. 40-70 wt. % water immiscible second oil-based phase; and d. 0.1 to 6 wt. % of defibrillated primary cell wall material comprising microfibrils in the aqueous phase, wherein defibrillation is made by subjecting the primary cell wall material to high-shear selected from high pressure homogenisation at a pressure of between 500 and 2000 bar and microfluidising at a pressure of between 500 and 2000 bar;

wherein the primary cell wall material is sourced from plant parenchymal tissue;

at least 80 wt. % of the microfibrils is smaller than 50 nm in diameter.

2. The cleaning composition according to claim 1, comprising from 0.2 to 60 wt % of the one or more surfactants.

3. The cleaning composition according to claim 1, wherein the one or more detergent surfactants are selected from one or more of anionic surfactants, cationic surfactants, non-ionic surfactants, amphoteric surfactants and zwitterionic surfactants.

4. The cleaning composition according to claim 1, comprising from 0.2 to 1.0 wt. % of the defibrillated primary cell wall material.

5. The cleaning composition according to claim 1, wherein said immiscible oil-based phase is liquid and is selected from the group consisting of silicone oil, triglyceride oil, mineral oil, etheric oils, and mixtures thereof.

6. The cleaning composition according to claim 1, wherein said immiscible oil-based phase is solid and is selected from the group consisting of gelled oils, structured oils and mixtures thereof.

7. A method for preparing a cleaning composition, wherein the cleaning composition comprises:

a. water;

b. 2 to 70 wt. % of one or more detergent surfactants; and c. 0.1 to 6 wt. % of defibrillated primary cell wall material comprising microfibrils in the aqueous phase;

d. 40 to 70 wt. % water immiscible oil-based phase;

and wherein the primary cell wall material is sourced from plant parenchymal tissue, at least 80 wt. % of the microfibrils is smaller than 50 nm in diameter;

and wherein the method comprises the steps of:

i. providing a source of primary cell wall material;

ii. dispersing the primary cell wall material in an aqueous phase, thereby to form an aqueous dispersion comprising between 0.1 and 6 wt. % of the primary cell wall material;

iii. treating the aqueous dispersion to obtain a dispersion comprising defibrillated primary cell wall material, whereby the treatment includes a high shear treatment step selected from high pressure homogenisation at a pressure of between 500 and 2000 bar and microfluidising at a pressure of between 500 and 2000 bar;

wherein other constituents of the cleaning composition are independently mixed into the aqueous phase before step ii, between steps ii and iii, after step iii.

8. The method according to claim 7, wherein the high shear treatment step is high pressure homogenisation at a pressure of between 500 and 1000 bar.

9. The cleaning composition obtainable by the method according to claim 7.

10. The cleaning composition of claim 1, comprising 0.5 to 50 wt. % of the one or more surfactants.

11. The cleaning composition of claim 10, comprising 5 to 35 wt. % of the one or more surfactants.

12. The method of claim 8, wherein the pressure is between 600 and 800 bar.

* * * * *